US005464006A

United States Patent [19]

Ledjeff et al.

[11] Patent Number: 5,464,006

[45] Date of Patent: Nov. 7, 1995

[54] WATER HEATER

[75] Inventors: Konstantin Ledjeff, Bad Krozingen; Alexander Schuler, Freiburg; Jurgen Gieshoff, Reute, all of Germany

[73] Assignee: Fraunhofer-Gesellschaft zur Forderung der Angewandten Forschung E.V., Munich, Germany

[21] Appl. No.: 256,305

[22] PCT Filed: Jan. 27, 1993

[86] PCT No.: PCT/DE93/00079

§ 371 Date: Jun. 30, 1994

§ 102(e) Date: Jun. 30, 1994

[87] PCT Pub. No.: WO93/16335

PCT Pub. Date: Aug. 19, 1993

[30] Foreign Application Priority Data

Feb. 13, 1992 [DE] Germany ..... 42 04 320.4

[51] Int. Cl.[6] ..... F24H 1/12

[52] U.S. Cl. ..... 126/361; 122/367.3; 431/328

[58] Field of Search ..... 431/328; 126/361, 126/92 A, 92 C; 122/367.1, 367.3

[56] References Cited

U.S. PATENT DOCUMENTS

| | | | |
|---|---|---|---|
| 3,223,081 | 12/1965 | Hunt | 431/328 X |
| 3,804,163 | 4/1974 | Bradley et al. | 431/328 X |
| 4,089,303 | 5/1978 | Brulfert | 431/328 X |
| 4,112,675 | 9/1978 | Pillsbury et al. | 431/328 X |
| 4,927,353 | 5/1990 | Nomura et al. | 431/328 X |
| 5,205,731 | 4/1993 | Reuther et al. | 431/328 X |
| 5,211,552 | 5/1993 | Krill et al. | 431/328 X |
| 5,281,131 | 1/1994 | Goldstein et al. | 431/328 X |

FOREIGN PATENT DOCUMENTS

3332572A1 3/1985 Germany .

*Primary Examiner*—William E. Tapolcai
*Attorney, Agent, or Firm*—Baker & Daniels

[57] ABSTRACT

A water heater has a gas inlet (8) for a mixture of gas and air and an inlet for a fluid (2) to be heated. The gas-air mixture passes through a combustion chamber (11,18) which is at least partly surrounded by at least one fluid chamber (4,7) filled with the fluid (2). The exhaust gas leaving the combustion chamber(s) (11,18) passes through an exhaust gas heat exchanger together with the fluid (2). Here there are two combustion stages, the first (16) being a catalytic gap burner (11) and the second being a monolithic burner (18,19). Owing to the two-stage arrangement, about 80% of the combustion gas is burned in the combustion stage (16) while the remainder is consumed even at the low partial pressures in the second combustion stage (20) virtually without any residue, and especially without emission of $NO_x$.

12 Claims, 3 Drawing Sheets

WATER HEATER

BACKGROUND OF THE INVENTION

The invention concerns a water heater with a gas inlet for a fuel gas/air mixture, an inlet for a fluid to be heated, at least two combustion stages with catalytic combustion chambers traversed by the fuel gas/air mixture and surrounded at least partly by at least one fluid chamber filled with the fluid, and with an exhaust gas heat exchanger traversed in various chambers by the exhaust gas escaping from the combustion chambers. The second combustion stage is fashioned as a monolithic burner.

Water heaters of that type are known in heating construction and, for instance, serve to heat water for an apartment heating system and to safeguard, as the case maybe, the hot-water supply of these apartments via a further water-water heat exchanger. Prior flame burners have the disadvantage of a high harmful $NO_x$ emission. Known from DE 33 32 572 A1 is a catalytic burner featuring a lower emission of noxious matter.

This device according to DE 33 32 572 A1 possesses two separate air supplies feeding primary and secondary air before the first combustion stage respectively between the first and second combustion stages. This separate air supply at a 60/40 percent ratio is to assure the heat release at 50 percent each in both stages.

This water heater consists in its catalytic combustion stages of two identical monolithic burners embedded each between two heat exchangers, with metal grids intended to prevent a flashback. Additionally, an uncoated ceramic element is arranged between said metal grid and the monolithic burner; it serves to prevent flashbacks and open combustion outside the combustion space proper.

This device has a number of disadvantages. For one, it requires an accurate air control for distribution of the supplied primary air and secondary air amount. Such a control with the additionally necessary piping complicates the structure of the water heater. While this design achieves gas compositions which avoid the generation of a critical temperature in the combustion chambers, the arrangement of the ceramic plate and metal grid does not prevent the flame operation between the two ceramic bodies with and without catalyst; on the contrary, even a heavy increase of the overall pressure drop of the burner occurs.

Due to the arrangement of the heat exchangers and to the quasi adiabatic operation, only the convective part is used in utilizing the heat energy generated. Due to the poor thermal conductance of the ceramic monoliths, which are exposed each to about 50 percent of the heat generated, so-called hot spots can occur in the monolithic burners, which may lead to premature aging of the catalysts.

Based on this prior art, the problem underlying the invention is to provide a water heater of the initially mentioned type which allows with a simple structure higher fuel utilization with lower emissions of noxious matter.

This problem is inventionally solved for a water heater according to the present invention in that the first combustion stage is fashioned as a catalytic gap burner, the combustion gap forming the combustion chamber of the first combustion stage and traversed by the gas mixture being bounded between a wall lined with a ceramic layer on the side facing the fluid chamber and a side coated with a catalyst layer, and in that the gap width is predetermined, in contingence on the flow velocity given by the gas throughput, in such a way that the flashback velocity is lower than the said flow velocity. By using a dual stage catalytic burner with stages configured for different heat capacities it is possible to convert the fuel gas without any residue, so that neither the fuel gas nor an $NO_x$ share can be detected in relevant magnitude in the exhaust gas leaving the water heater. Owing to the design of the combustion gap of the first stage between a wall lined with a ceramic layer on the side facing the fluid chamber and a side coated with the catalyst layer, it is possible to maintain the temperatures of 800° Celsius that are necessary for a high conversion rate and to assure at the same time a swift heat transfer to the fluid to be heated.

Flashback is effectively prevented by predetermining the gap width in contingence of the traverse flow velocity given by the gas throughput, in such a way that the flashback velocity is lower than the said traverse flow velocity.

With the fuel gas mixture, prior to introduction in the catalytic combustion gap, able to be passed in counterflow along the backside of the wall lined with the catalytic layer, for preheating of the mixture, said fuel gas mixture can be preheated by the heat released during the reaction, so that nearly ideal conversion temperatures prevail throughout the combustion gap.

BRIEF DESCRIPTION OF THE DRAWINGS

Several embodiments of the invention will now be more fully explained with the aid of the drawings, which shows in.

DESCRIPTION OF THE PREFERRED EMBODIMENT

Figure 1:
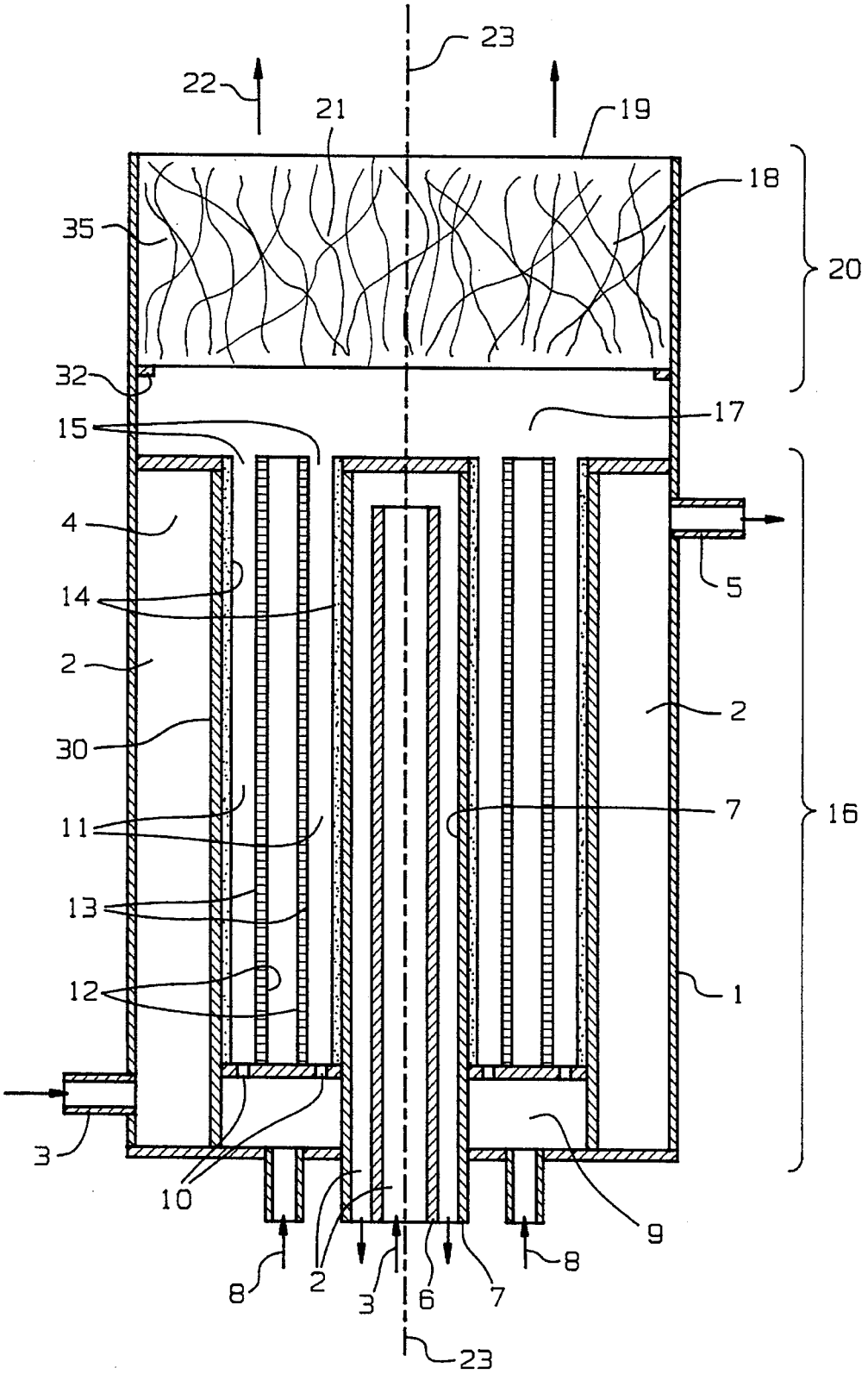
FIG. 1, a schematic section of a water heater according to a first embodiment of the invention, in side elevation.

FIG. 1 shows the essential elements of a water heater according to a first embodiment of the invention. Meant by water heater is a device with which any other fluid can be heated and which is based on the technical features of a heating device for water. Thus, the expert will view as a medium to be heated any fluid, with the heating of water, also used in mixtures, being a special case.

A customary hot-water supply for a building with several dwelling units requires heating capacities of, e.g., 15 to 30 kilowatts. These are favorably made available in individual modules of for instance 1 to 5 kilowatts of capacity, so that it is possible to individually configure the number of modules needed for the required heating capacities. Such a module is illustrated in FIG. 1. As compared to the modules shown in the other figures, it features a higher gas throughput and a higher heating capacity.

The module is installed in an essentially cylindrical hollow part 1. The fluid to be heated, for instance water, which in the respective chambers is referenced 2, is passed into the interior of the module via a bottom, side inlet 3 and another inlet which is centrally arranged around the cylinder axis 23. The fluid flowing in the ring-shaped fluid chamber 4 leaves said chamber on the side opposite inlet 3 via an upper outlet 5. The centrally entering fluid 2 flows within the pipe 6 into the module and leaves again in counterflow, coaxially in a sleeve 7 covered at its upper end, around the inlet site.

The cool fluid 2 is heated by gas undergoing conversion.

It consists of a fuel gas/air mixture which through inlets 8 arranged on the underside of the module is passed into it. Spaces 9 for gas distribution and turbulation are favorably provided in the module behind the inlets 8, where the gas is homogeneously mixed. The fuel gas/air mixture leaves these spaces 9 via openings 10 and proceeds into combustion gaps 11 bordering on hollow, cylindrical tubes 12. The latter preferably consist of a metal coated on its outside with a catalyst 13. The opposite side of the respective combustion gap 11 is formed by a fluid chamber wall 30, which here is cylindrical as well and covered with a thermally insulative resistant ceramic layer 14 lining the walls of the two fluid chambers 4 and 7. The gas flowing through opening 10 into the combustion gaps 11 is converted on the catalytically acting surface 13 while giving off heat. This heat is transferred to the fluid 2 via the ceramic layer 14 acting as thermal insulation layer, which fluid is thus heated and flows in the coolant circuit out of outlet 5.

The catalyst layer 13 consists preferably of a precious metal, preferably platinum or palladium. Other suitable materials are the oxides of several Transition Elements and certain Perovskite, for instance calcium titanium oxide.

Direct contact of the fluid chamber wall 30 with the combustion gap 11 and, by gas convection, with the wall 12 clad with the catalyst layer 13 is preferably avoided, since the gas should reach a temperature of preferably 800 degrees Celsius in the conversion and since the conversion process starts only at 350 degrees Celsius. The thermal insulation layer 14 opposite the fluid chambers 4 and 7 consists in the presently described embodiments of a ceramic layer. But it may be formed as well by a gas layer enclosed in a separate intermediate chamber.

The hollow cylinder 12 supporting the catalyst layer 13 is preferably hollow, in order for the heat not to be able to flow at the start of the catalytic reaction into any solid cylinder serving as heat store, but serves directly for heating the catalyst layer and the gas mixture. Leading to temperatures above 800 degrees Celsius, the additional heat, furthermore, can be transferred to the fluid 2 at thermal equilibrium, directly and without heating an intermediate store. The hollow cylinder 12 consists favorably of a thin metallic tube, whereby a uniform heat tone of the catalyst layer 13 across nearly its entire cylinder surface can be guaranteed, since the speed of reaction depends notably on the temperature and concentration, respectively the partial pressures of the participating gases.

The temperature in the lower initial conversion range of the combustion gap 11 ranges at the start of the reaction at approximately 350 degrees Celsius, thus at least far below 800 degrees Celsius, so that the conversion process cannot proceed at the potential velocity. Therefore, the thin metallic tube 12 acts here as a heating component which passes the heat generated in the medium conversion range directly to the lower region, so that an optimum temperature prevails there as well immediately after reaction start.

In the upper terminal region of the combustion gap 11 a large percentage of the combustion gas has already been converted so that, due to the dropping partial pressures, the reaction speed slows down. Additionally, the diminishing reaction speed leads to a temperature drop of the catalyst layer 13, so that an even more drastic reduction in reaction speed would have to be expected, which would leave a high remaining surplus of unburned gas. Here, the thin metallic tube 12 offsets the temperature drop caused by the diminishing reaction speed, by supplying heat from the center, hot region of the catalyst layer 13, so that a satisfactory conversion is achievable despite dropping partial pressures in the upper terminal region of the combustion gap 11 measuring 10 to 20 centimeters in length.

The described gas gap 11 serving combustion has a width which at the flow velocity given due to the gas throughput is preselected in such a way that the flashback velocity, which likewise is given due to the kind of fuel gas used, is lower than the said flow velocity in forward direction. The temperature of the gas mixture is higher than the self-ignition temperature, making it possible to prevent thereby a flashback and the formation of a stable flame.

The gas issuing out of the upper openings 15 of the combustion gaps 11 of the first combustion stage 16 of the catalytic burner still contains about 10 to 30 percent fuel gas. The gas is freely distributed in the air gap 17, allowing it to penetrate the pores 18 of the catalyst sponge 19. The latter consists of a ceramic foam with a fine-pored structure coated with the catalyst material. Such catalyst structure is referred to as "monolithic burner" 20.

Within burner 20, the spacing between the individual catalyst material bearing walls of the pores 18 of the sponge 19, is much smaller than in the combustion gap 11, so that even with the low partial pressures in the available residual fuel gas the remaining fuel gas particles will be converted virtually without leaving any residue. In the process, even with the lowest fuel gas concentrations, temperatures of about 1000 degrees Celsius are generated. The corresponding heat can hardly be given off via the thermally poorly conducting catalyst sponge material, so that the high temperature of 1000 degrees Celsius, favoring the diffusion velocity of the gas particles, can be kept in a center, with respect to the axis 23 essentially cylindrical region 21 of the monolithic burner 20.

The size of the pore material depends on the desired combustion capacity and is also so chosen that the temperature which is achieved will not rise greatly above the said 1000 degrees Celsius, since otherwise the catalyst material might oxidize and/or nitrogen oxides might form. At the said operating temperature of 1000 degrees Celsius, the fuel gas— without leaving any residue— is in the second combustion stage 20 so burned that $NO_x$ emissions and fuel gas residues could be detected only with highly sensitive measuring technology and that they can be released in the air without hesitation. The exhaust gas referenced 22 is then brought in contact with the cool fluid 2 escaping from outlet 5, in an exhaust gas heat exchanger not illustrated in the figures, so that the heat contained in the exhaust gas can further heat the cool fluid 2. Besides, this provides with appropriate routing of the fuel gas/air mixture feed piping the option of preheating the fuel gas/air mixture.

Described has thus been a dual-stage catalytic burner which allows a fuel gas combustion without leaving any residues and where the dimensions to be provided for are favorable in their space demands. Based on a capacity of several kilowatts, the length of the first combustion stage 16 is in the order of 10 to 15 centimeters, which after a turbulation gap 17 of 1 to 2 centimeters is followed by the catalyst sponge 19 of about 3 centimeters in depth.

In configuring the size ratios it is merely necessary to make sure that the second combustion stage 20 is an essentially adiabatic process, that the flow velocities of the first combustion stage 16 are adapted to those of the second combustion stage 20 via the gap widths 11 and the pore widths 18, and that the catalyst surfaces of the first (16) and second (20) combustion stage are at the proper ratio.

Advantageous on the embodiment illustrated in FIG. 1 is that the two combustion stages 16 and 20 can be inserted in a pipe 1 with constant outside diameter. The sponge 19 rests in a simple embodiment of the invention on a lateral, inner support ring 32 which at the same time prevents a direct gas admission to the outermost marginal regions 35 of the sponge 19, so that these regions 35 do not participate in the conversion process and act as thermal insulation layer.

It is also possible for the second combustion stage 20 to have in relation to the axis 23 a larger diameter, thereby enlarging the surface of the catalyst sponge 19 of normal orientation to the axis 23 of the setup, allowing then an appropriate reduction of the depth of the second combustion stage 20, provided the turbulation gap 17 is sufficiently deep to allow a lateral distribution of the residual fuel gas/air mixture influx without excessive cooling. The distribution gap has preferably a width of less than one to about 5 centimeters.

Figure 2:
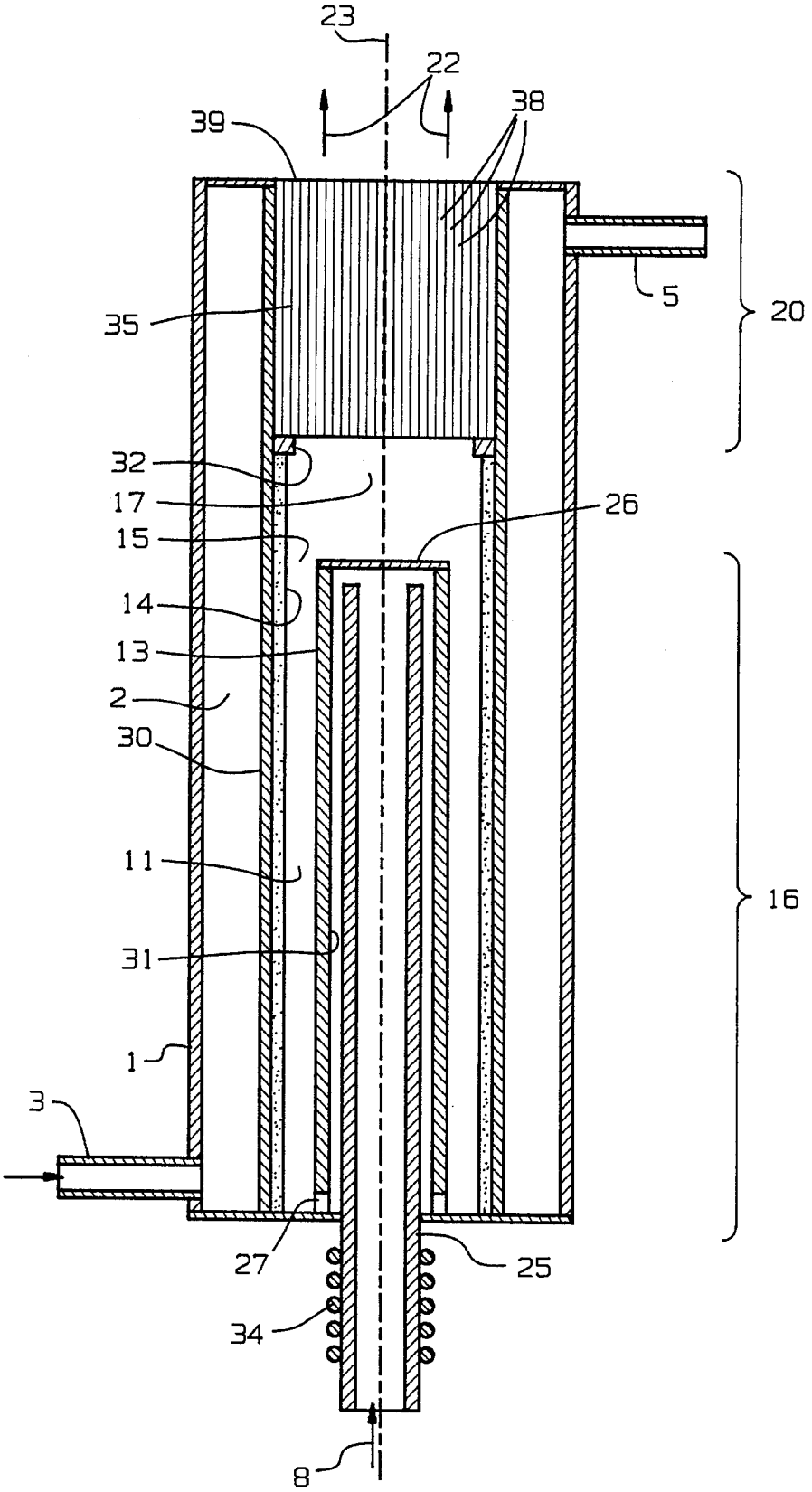
FIG. 2, a schematic section of a water heater according to a second embodiment of the invention, in side elevation, and FIG. 3, a schematic section of a water heater according to a third embodiment of the invention, in side elevation.

FIG. 2 shows a second embodiment of the invention where identical features are referenced the same as in the preceding figure.

Analogous to FIG. 1, cold fluid 2 is carried by the lower inlet 3 into the ring-shaped fluid chamber 4 and via the upper outlet 5 to the exhaust gas heat exchanger. Arranged on the inside of the fluid chamber wall 30 coaxial in relation to the axis 23 is a thermal insulation layer, which preferably consists of a ceramic tube 14.

Fashioned between this ceramic tube 14 and the as well cylindrical catalyst wall 31 coated with the catalyst is the combustion gap 11, the length of which favorably ranges between 10 and 30 centimeters. The fuel gas is introduced centrally through a pipe 25 arranged on the axis 23, rerouted at an upper end plate 26 into the coaxially arranged catalytic-wall pipe 31 so as to return in counterflow relative to the combustion gap 11 and proceed through radially arranged openings 27 at the bottom end of the module into the combustion gap 11. Owing to this double counterflow principle, the fuel gas/air mixture is preheated by heat conductance and, as the case may be, heat radiation by the heat generated on the catalyst layer 13, as a result of which the fuel gas/air mixture possesses a suitable temperature favoring the conversion already when entering the combustion gap 11 via the outlet openings 27.

At the start of the conversion process, the fuel gas/air mixture may need to be preheated to the starting temperature of several hundred degrees Celsius. Provided for that purpose is an electric heating coil 34 which in the area of gas mixture inlet 8 surrounds the feed pipe 25. Also provided, in the area of the catalytic combustion gap 11 of the first combustion stage and not illustrated in FIG. 1, is a thermosensor whose temperature signal enables the cut-in of heating coil 34 in the presence of a cold gas mixture and its cut-out upon reaching a preselected gas mixture temperature.

In the embodiment according to FIG. 2, the ring-shaped cooling shell extends along the first (16) and second (20) combustion stage. In the area of the first combustion stage 16, i.e., bordering on the combustion gap 11, and favorably also in the area of the distribution space 17, the ceramic pipe 14 is provided on the fluid chamber wall 30. It borders then on the inner ring 32 on which a catalyst honeycomb 39 is placed.

Illustrated by parallel lines, the catalyst honeycomb 39 consists of a plurality of adjacent honeycomb-shaped tubelets 38 of ceramic material which are clad with the catalyst material, for instance platinum. Such a catalyst is called "monolithic burner" 20 as well. Within it, the distance between the individual walls supporting the catalyst material is considerably smaller than the respective spacings in the combustion gap 11, so that even with the low partial pressure prevailing in the fuel gas the remaining fuel gas particles are converted practically without leaving any residues.

The marginal areas 35 of the catalyst honeycomb 39 of the second combustion stage 20 are covered by the inner ring 32, causing them to act as thermal insulation layer relative to the fluid chamber 4, as a result of which the high temperatures within the center area 21 can be utilized also with low fuel gas concentrations.

Figure 3:
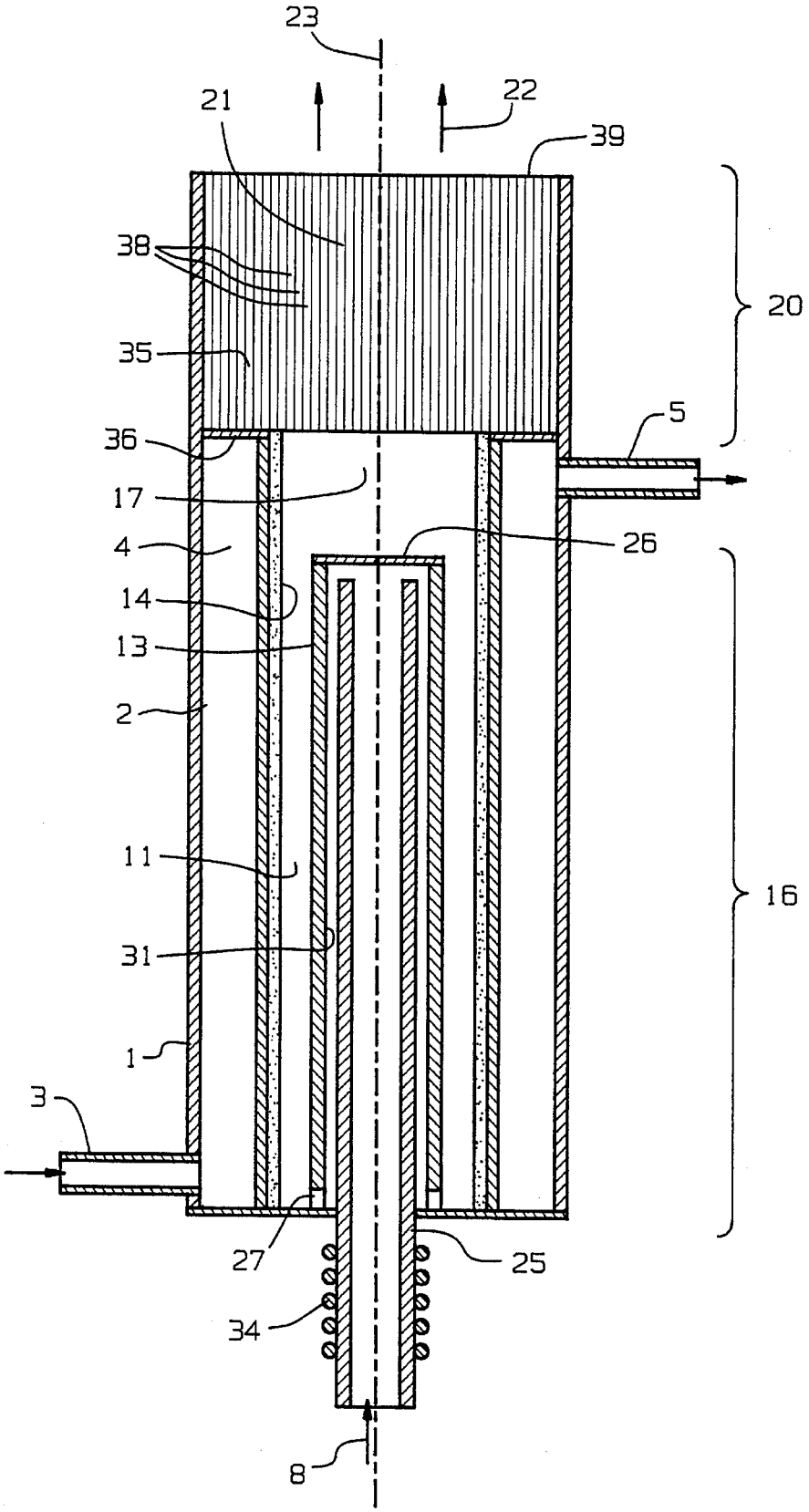

Illustrated in FIG. 3 is a third embodiment of a water heater. Similar features of this setup are referenced the same as in FIG. 1 and FIG. 2. The setup according to FIG. 3 notably is an advancement of the module pursuant to FIG. 2. The structure of the counterflow preheating of the fuel gas/air mixture is analogous, and there exists as well only one ring-shaped fluid chamber 4.

But the fluid chamber 4 with the ceramic pipe 14 attached to its wall 30 is extended only up to the area of gap 17. It is terminated by a radial perforated plate 36 on which the catalyst honeycomb 39 is placed, so that the residual fuel gas is already by design admitted only to the central area 21 of the catalyst honeycomb 39. Illustrated by parallel lines, the outer (35) honeycomb-shaped tubelets 38 of the catalyst honeycomb 39 are not acted upon by the gas, since they are covered by the perforated plate 36. Consisting of ceramic material, these tubelet walls thus act as thermal insulation relative to the surrounding pipe 1, so that the high temperatures within the center area 21 can be utilized even with low fuel gas concentrations.

The fuel gas/air mixture 3 may consist of a mixture of air and methane, but another hydrocarbon, such as propane or butane, may be used as well. Possible also is the use of alcohols, such as methanol and ethanol, mixed with air. Also concerned, of course, may be natural gas supplied by gas companies, which then can be burned free of $NO_x$.

Especially platinum or palladium can be used as catalyst material, with the catalyst material in the two combustion stages allowed to be the same or also different.

In addition or as an alternative to the ceramic layer 14, a gas-filled chamber or a vacuum chamber may be provided as thermal insulation layer. The thickness of the thermal insulation layer is such that with the intended gas throughput the predetermined temperature which is optimal for the fuel gas/air mixture to be converted in the area of the combustion gap 11 will prevail while at the same time the heat obtained beyond can be transferred to the fluid 2 to be heated.

Differing in their combustion space configuration, the second combustion stages 20 described in FIG. 1, 2 and 3 can be exchanged as regards the various first combustion stages 16. Additionally it is possible to establish the features of a monolithic burner 17 set forth in FIG. 2 in a larger module, as the one in FIG. 1, with several pipes 12 which are axially symmetric in relation to the axis 23.

Symmetric in relation to an axis 23, the illustrated chambers form a particularly favorable, space-saving embodiment requiring simple engineering. But any other, for instance square-shaped chamber form may be chosen. Also, several inlets and outlets 3, 5 and 8 my be provided for the various fluids and/or distribution chambers 9.

We claim:

1.A water heater with a gas inlet for a fuel gas/air mixture, said fuel gas in said fuel gas/air mixture having a flashback velocity, an inlet for a fluid to be heated, at least two combustion stages which are adapted to be traversed by the fuel gas/air mixture, each said combustion stage having a catalytic combustion chamber, a first said combustion chamber encircled by a fluid chamber, said fluid chamber adapted to be traversed by a said fluid, an exhaust gas heat exchanger for exchanging heat between said fluid and exhaust gas escaping from said first combustion chamber, the second combustion stage defining a monolithic burner, the first combustion chamber defining a catalytic gap burner and including a combustion gap which is traversed by the fuel gas/air mixture, said first combustion chamber defined by a first wall which is lined with a ceramic layer on the side adjacent the fluid chamber, a second wall defining said first combustion chamber and coated with a catalytic coating the width of said combustion gap selected so that the flashback velocity of the fuel gas is lower than the flow velocity of the fuel gas/air mixture traversing said first combustion chamber.

2. A water heater according to claim 1, including means for passing the fuel gas/air mixture, prior to its introduction in the catalytic combustion gap in counterflow along the backside of the second wall for preheating the mixture.

3. A water heater according to claim 1, wherein the monolithic burner is traversed by the fuel gas/air mixture escaping from the first combustion stage in only a predetermined central area, so that the non-central area of the second combustion stage does not participate in the combustion process and forms a heat shield relative to the outside walls of the water heater.

4. A water heater according to claim 1, including a feed pipe for supplying the fuel gas/air mixture to the first combustion chamber, said feed pipe including an inlet, an electric heating coil surrounding the feed pipe adjacent the inlet, for preheating said fuel gas/air mixture, a thermosensor disposed in the catalytic combustion gap of the first combustion stage, said thermosensor enabling energization of the heating coil in the event of a low fuel gas/air mixture temperature, and enables deenergization of the heating coil when the fuel gas/air mixture reaches a predetermined temperature.

5. A water heater according to claim 1, including a distribution and turbulation gap between the two combustion stages.

6. A Water heater according to claim 1, wherein the fluid chamber surrounds only the first combustion stage.

7. A water heater according to claim 1, wherein the monolithic burner defines a catalyst honeycomb.

8. A water heater according to claim 1, wherein the monolithic burner defines a catalyst foam.

9. A water heater according to claim 1, including a turbulation chamber provided in fluid circuit with an inlet to said first combustion chamber.

10. A water heater according to claim 1, wherein said second wall comprises a thin metallic sublayer which provides good heat distribution along the conversion area of the combustion gap.

11. A water heater according to claim 1, wherein the catalytic layer consists of platinum, palladium or oxidic materials.

12. A water heater according to claim 1, wherein the fuel gas is an alkane or an alcohol.

* * * * *